US012669290B2

(12) United States Patent
Numata et al.

(10) Patent No.: US 12,669,290 B2
(45) Date of Patent: Jun. 30, 2026

(54) SHELL-AND-PLATE HEAT EXCHANGER

(71) Applicant: DAIKIN INDUSTRIES, LTD., Osaka (JP)

(72) Inventors: Mitsuharu Numata, Osaka (JP); Kou Terai, Osaka (JP); Yutaka Shibata, Osaka (JP); Hirokazu Fujino, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 419 days.

(21) Appl. No.: 17/857,893

(22) Filed: Jul. 5, 2022

(65) Prior Publication Data

US 2022/0333872 A1 Oct. 20, 2022

Related U.S. Application Data

(63) Continuation of application No. PCT/JP2021/001000, filed on Jan. 14, 2021.

(30) Foreign Application Priority Data

Jan. 14, 2020 (JP) ..... 2020-003837

(51) Int. Cl.
*F28D 9/00* (2006.01)
*F28D 21/00* (2006.01)
*F28F 3/08* (2006.01)

(52) U.S. Cl.
CPC ..... *F28D 9/005* (2013.01); *F28D 21/00* (2013.01); *F28F 3/08* (2013.01); *F28D 2021/0068* (2013.01)

(58) Field of Classification Search
CPC . F28D 9/005; F28D 21/00; F28D 3/08; F28D 2021/0068
See application file for complete search history.

(56) References Cited

U.S. PATENT DOCUMENTS 7,594,538 B2 * 9/2009 Stenhede ..... F28D 9/0006 165/145
8,910,493 B2 * 12/2014 Ringwaldt ..... F28F 3/042 62/304

(Continued)

FOREIGN PATENT DOCUMENTS

CN 1842689 A 10/2006
EP 3 372 941 A1 9/2018

(Continued)

OTHER PUBLICATIONS

International Preliminary Report of corresponding PCT Application No. PCT/JP2021/001000 dated Jul. 28, 2022.

(Continued)

*Primary Examiner* — Kristina N Junge
(74) *Attorney, Agent, or Firm* — Spencer Fane LLP

(57) ABSTRACT

A shell and plate heat exchanger includes a shell forming an internal space, and a plate stack housed in the internal space. A plurality of refrigerant channels communicate with the internal space, and a plurality of heating medium channels are blocked from the internal space. Each of the refrigerant channels is adjacent to an associated one of the heating medium channels with heat transfer plate interposed between. Each of the heat transfer plates includes a first communication hole that communicates with the heating medium channels to introduce the heating medium, a second communication hole formed below the first communication hole that communicates with the heating medium channels to emit the heating medium, and a guide crossing between the first and second communication holes to guide the heating medium that has flowed into the heating medium channels from the first communication hole toward side portions of the heat transfer plate.

12 Claims, 7 Drawing Sheets

(56) References Cited

U.S. PATENT DOCUMENTS

| | | | | |
|---|---|---|---|---|
| 10,234,212 | B2 * | 3/2019 | Noel-Baron | F28F 3/044 |
| 11,162,736 | B2 * | 11/2021 | Strömer | F28F 3/04 |
| 11,371,781 | B2 * | 6/2022 | Christensen | F28D 9/0006 |
| 11,480,393 | B2 * | 10/2022 | Skoglösa | F28D 9/0006 |
| 2006/0191672 | A1 | 8/2006 | Stenhede et al. | |
| 2011/0120672 | A1 * | 5/2011 | Ringwaldt | F28D 3/00 165/104.14 |
| 2014/0251579 | A1 * | 9/2014 | Sloss | F28F 27/02 165/96 |
| 2018/0128549 | A1 * | 5/2018 | Takeda | F28D 9/0043 |
| 2020/0173736 | A1 * | 6/2020 | Dahlberg | F28D 9/0093 |
| 2021/0222961 | A1 | 7/2021 | Takeda et al. | |
| 2021/0262735 | A1 * | 8/2021 | Yin | F28F 3/025 |
| 2022/0404099 | A1 * | 12/2022 | Arnou | F28D 9/0056 |

FOREIGN PATENT DOCUMENTS

| | | | |
|---|---|---|---|
| EP | 3 676 553 | B1 | 12/2020 |
| JP | 2006-527835 | A | 12/2006 |
| JP | 2020-46111 | A | 3/2020 |

OTHER PUBLICATIONS

International Search Report of corresponding PCT Application No. PCT/JP2021/001000 dated Mar. 2, 2021.

European Search Report of corresponding EP Application No. 21 74 0923.4 dated May 15, 2023.

* cited by examiner

SIDE

FRONT

FIRST PLATE

SECOND PLATE

SHELL-AND-PLATE HEAT EXCHANGER

CROSS-REFERENCE TO RELATED APPLICATIONS

This is a continuation of International Application No. PCT/JP2021/001000 filed on Jan. 14, 2021, which claims priority to Japanese Patent Application No. 2020-003837, filed on Jan. 14, 2020. The entire disclosures of these applications are incorporated by reference herein.

BACKGROUND

Technical Field

The present disclosure relates to a shell-and-plate heat exchanger.

Background Art

Japanese Unexamined Patent Publication No. 2006-527835 discloses a shell-and-plate heat exchanger (a heat exchanger apparatus) having a plate package including a plurality of heat exchange plates and a tank that houses the plate package. This heat exchanger is a flooded heat exchanger in which a liquid refrigerant is stored in a lower space of the tank. The liquid refrigerant in the tank evaporates when liquid refrigerant exchanges heat with a fluid flowing through the plate package. The evaporated refrigerant flows outside from the top of a shell.

SUMMARY

A first aspect of the present disclosure is directed to a shell and plate heat exchanger including a shell forming an internal space, and a plate stack housed in the internal space of the shell. The plate stack includes a plurality of heat transfer plates stacked in a lateral direction and joined together. The shell and plate heat exchanger is configured to allow a refrigerant that has flowed into the internal space of the shell to evaporate. The plate stack forms a plurality of refrigerant channels that communicate with the internal space of the shell and allow a refrigerant to flow through, and a plurality of heating medium channels that are blocked from the internal space of the shell and allow a heating medium to flow through. Each of the refrigerant channels is adjacent to an associated one of the heating medium channels with heat transfer plate interposed therebetween. Each of the heat transfer plates includes a first communication hole that communicates with the heating medium channels to introduce the heating medium into the heating medium channels, a second communication hole formed below the first communication hole that communicates with the heating medium channels to emit the heating medium out of the heating medium channels, and a guide crossing between the first communication hole and the second communication hole to guide the heating medium that has flowed into the heating medium channels from the first communication hole toward side portions of the heat transfer plate.

DETAILED DESCRIPTION OF EMBODIMENT(S)

Embodiments will be described below with reference to the drawings. The following embodiments are merely exemplary ones in nature, and are not intended to limit the scope, applications, or use of the present invention.

Embodiment

General Configuration

A shell-and-plate heat exchanger (10) (will be hereinafter referred to as a "heat exchanger") of this embodiment is connected to a refrigerant circuit of a refrigeration apparatus (not shown). In this refrigeration apparatus, a refrigerant compressed by a compressor dissipates heat in a condenser (radiator), and is decompressed by a decompression mechanism. The decompressed refrigerant evaporates in a heat exchanger (10) that functions as an evaporator, and is sucked into the compressor. In this manner, a refrigeration cycle is performed in the refrigerant circuit of the refrigeration apparatus.

Figure 1B:
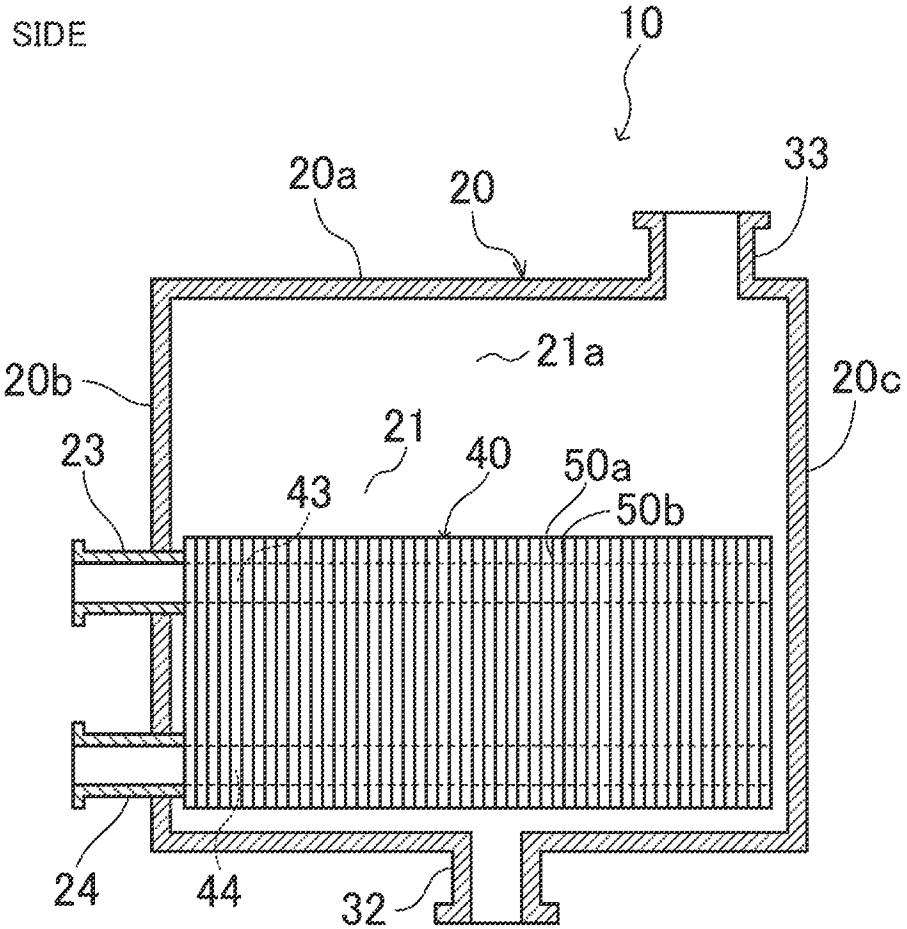
FIGS. 1A and 1B are a front view and a schematic cross-sectional view taken along line I-I in the front view, both illustrating a heat exchanger according to an embodiment.

As illustrated in FIG. 1, the heat exchanger (10) includes a shell (20) and a plate stack (40). The plate stack (40) is housed in an internal space (21) of the shell (20). A liquid refrigerant flows into the internal space (21) of the shell (20). The liquid refrigerant exchanges heat with a heating medium flowing in the plate stack (40). The heat exchanger (10) allows the refrigerant that has flowed into the internal space (21) of the shell (20) to evaporate, and thus, functions as an evaporator. Examples of the heating medium include water and brine.

Shell

The shell (20) is comprised of a horizontally long, cylindrical closed container. The shell (20) has a barrel (20*a*), a first sidewall (20*b*), and a second sidewall (20*c*). The barrel (20*a*) is formed in a cylindrical shape. The first sidewall (20*b*) is formed in a circular shape and blocks a left end of the barrel (20*a*). The second sidewall (20*c*) is formed in a circular shape and blocks a right end of the barrel (20*a*). The shell (20) forms the internal space (21) defined by the barrel (20*a*), the first sidewall (20*b*), and the second sidewall. The internal space (21) stores the liquid refrigerant.

The barrel (20*a*) has a refrigerant inlet (32) and a refrigerant outlet (33). The refrigerant inlet (32) is formed at the bottom of the barrel (20*a*). The refrigerant is introduced into the internal space (21) through the refrigerant inlet (32). The refrigerant outlet (33) is formed at the top of the barrel (20*a*).

The refrigerant evaporated in the internal space (21) is emitted out of the shell (20) through the refrigerant outlet (33). The refrigerant inlet (32) and the refrigerant outlet (33) are connected to the refrigerant circuit via pipes.

The first sidewall (20*b*) is provided with a heating medium inlet (23) and a heating medium outlet (24). The heating medium inlet (23) and the heating medium outlet (24) are tubular members.

The heating medium inlet (23) penetrates substantially the center of the first sidewall (20*b*). The heating medium inlet (23) is connected to a heating medium introduction path (43) of the plate stack (40) to supply the heating medium to the plate stack (40).

The heating medium outlet (24) penetrates the first sidewall (20*b*) at an appropriately intermediate position between the heating medium inlet (23) and a lower end of the first sidewall (20*b*). The heating medium outlet (24) is connected to a heating medium emission path (44) of the plate stack (40) to emit the heating medium out of the plate stack.

Plate Stack

The plate stack (40) includes a plurality of heat transfer plates (50*a*, 50*b*) stacked in the lateral direction and joined together. The plate stack (40) is housed in the internal space (21) of the shell (20) with the stacking direction of the heat transfer plates (50*a*, 50*b*) extending in the lateral direction.

Figure 1A:
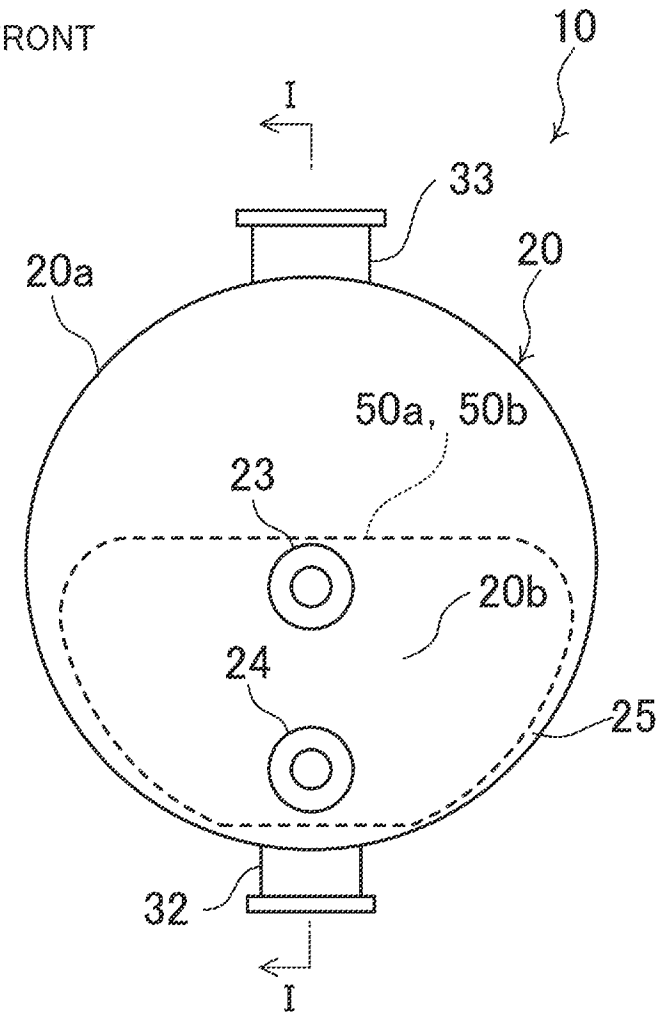

As illustrated in FIG. 1A, the heat transfer plates (50*a*, 50*b*) constituting the plate stack (40) are substantially semicircular plate-shaped members. The plate stack (40) is arranged near the bottom of the internal space (21) of the shell (20) with arc-shaped edges of the heat transfer plates (50*a*, 50*b*) facing downward. Although not shown, supports in the shape of protrusions for supporting the plate stack (40) protrude from the inner surface of the shell (20). The plate stack (40) housed in the internal space (21) of the shell (20) is spaced apart from the inner surface of the shell (20), and forms a gap (25) between the downward edges of the heat transfer plates (50*a*, 50*b*) of the plate stack (40) and the inner surface of the shell (20). An upper space (21*a*) is formed above the plate stack (40) in the internal space (21).

Figure 2:
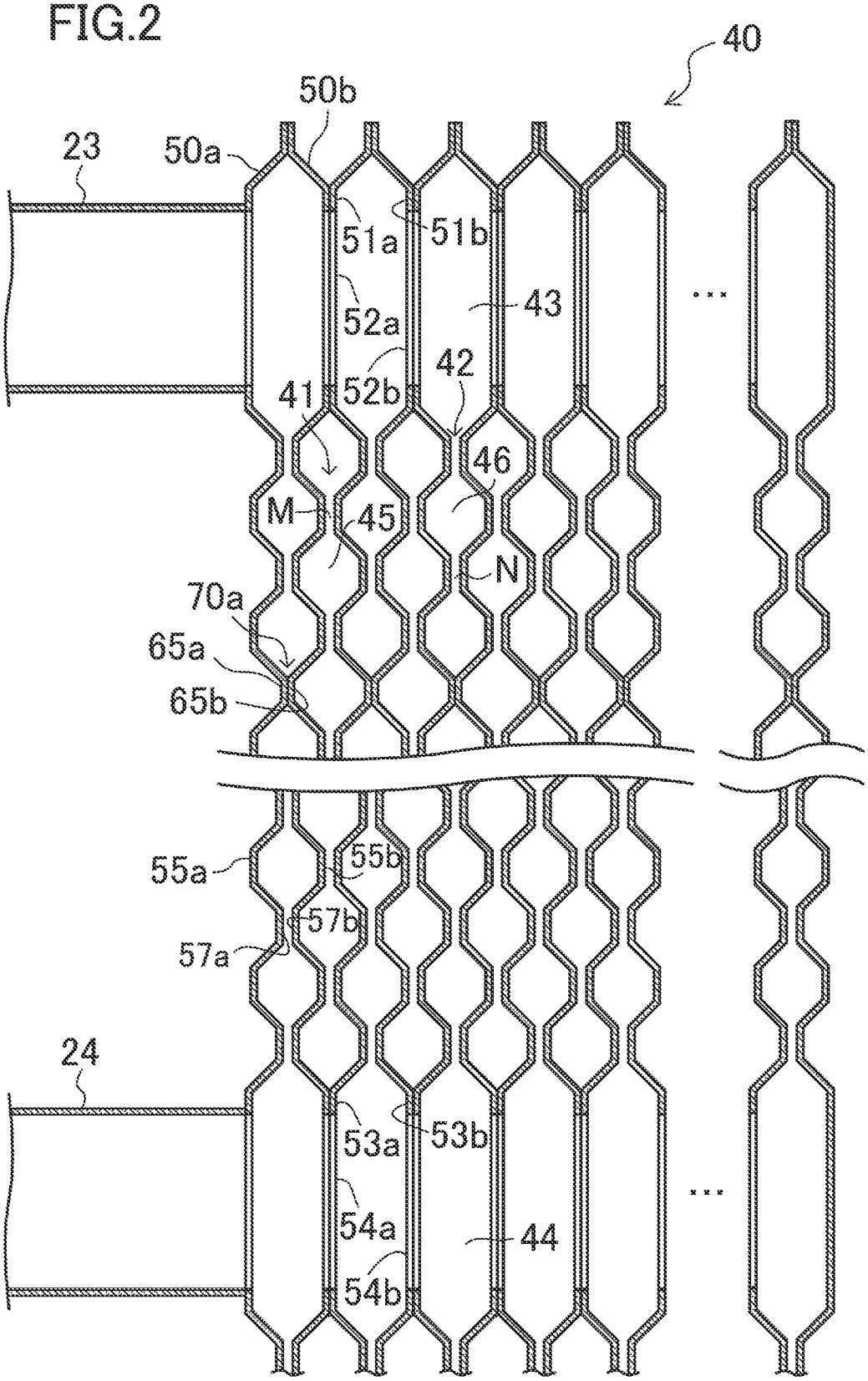
FIG. 2 is a schematic longitudinal cross-sectional view illustrating a plate stack, partially enlarged.
Figure 3A:
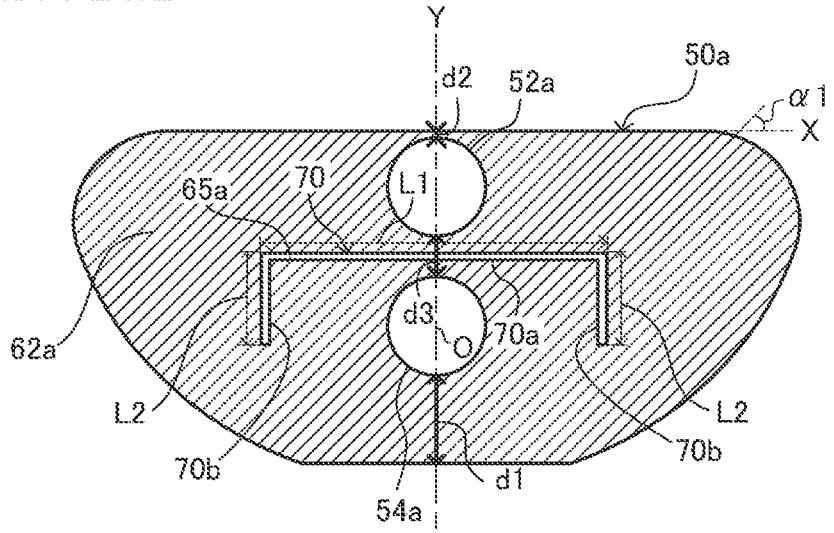
FIGS. 3A and 3B are schematic front views illustrating a first plate and a second plate.
Figure 3B:
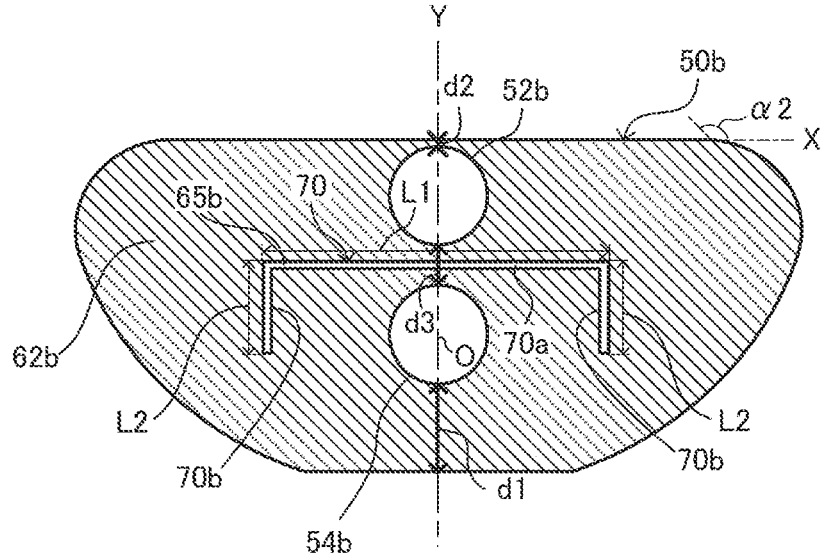

As illustrated in FIGS. 2, 3A, and 3B, the plate stack (40) includes first plates (50*a*) and second plates (50*b*) having different shapes as the heat transfer plates (50*a*, 50*b*). The plate stack (40) includes a plurality of first plates (50*a*) and a plurality of second plates (50*b*). The first plates (50*a*) and the second plates (50*b*) are alternately stacked to form the plate stack (40). In the following description, for each of the first plates (50*a*) and the second plates (50*b*), a surface on the left in FIG. 2 will be referred to as a front surface, and a surface on the right in FIGS. 3A and 3B will be referred to as a back surface.

Heating Medium Introduction Path and Heating Medium Emission Path

Each of the first plates (50*a*) has an inlet protrusion (51*a*) and an outlet protrusion (53*a*). Each of the inlet protrusion (51*a*) and the outlet protrusion (53*a*) is a circular portion bulging toward the front side of the first plate (50*a*). Each of the inlet protrusion (51*a*) and the outlet protrusion (53*a*) is formed in a widthwise center portion of the first plate (50*a*). The inlet protrusion (51*a*) is formed in an upper portion of the first plate (50*a*). The outlet protrusion (53*a*) is formed in a lower portion of the first plate (50*a*). A first inlet hole (52*a*) is formed in a center portion of the inlet protrusion (51*a*). The first inlet hole (52*a*) corresponds to a first communication hole of the first plate (50*a*). A first outlet hole (54*a*) is formed in a center portion of the outlet protrusion (53*a*). Each of the first inlet hole (52*a*) and the first outlet hole (54*a*) is a circular hole penetrating the first plate (50*a*) in a thickness direction.

In the first plate (50*a*), a first distance d1 between a lower end of the first outlet hole (54*a*) and a lower end of the first plate (50*a*) is greater than a second distance d2 between an upper end of the first inlet hole (52*a*) and an upper end of the first plate (50*a*). The first distance d1 is greater than a third distance d3 between an upper end of the first outlet hole (54*a*) and a lower end of the first inlet hole (52*a*). In this embodiment, the first distance d1 is twice or greater than the third distance d3.

Each of the second plates (50*b*) has an inlet recess (51*b*) and an outlet recess (53*b*). Each of the inlet recess (51*b*) and the outlet recess (53*b*) is a circular portion bulging toward the back side of the second plate (50*b*). Each of the inlet recess (51*b*) and the outlet recess (53*b*) is formed in a widthwise center portion of the second plate (50*b*). The inlet recess (51*b*) is formed in an upper portion of the second plate (50*b*). The outlet recess (53*b*) is formed in a lower portion of the second plate (50*b*). A second inlet hole (52*b*) is formed in a center portion of the inlet recess (51*b*). A second outlet hole (54*b*) is formed in a center portion of the outlet recess (53*b*). Each of the second inlet hole (52*b*) and the second outlet hole (54*b*) is a circular hole penetrating the second plate (50*b*) in a thickness direction.

In the second plate (50*b*), the inlet recess (51*b*) is formed at a position corresponding to the inlet protrusion (51*a*) of the first plate (50*a*), and the outlet recess (53*b*) is formed at a position corresponding to the outlet protrusion (53*a*) of the first plate (50*a*). In the second plate (50*b*), the second inlet hole (52*b*) is formed at a position corresponding to the first inlet hole (52*a*) of the first plate (50*a*), and the second outlet hole (54*b*) is formed at a position corresponding to the first outlet hole (54*a*) of the first plate (50*a*). The first inlet hole (52*a*) and the second inlet hole (52*b*) have a substantially equal diameter. The first outlet hole (54*a*) and the second outlet hole (54*b*) have a substantially equal diameter.

Thus, the positions of the second outlet hole (54*b*) and the second inlet hole (52*b*) in the second plate (50*b*) are the same as the positions of the first outlet hole (54*a*) and the first inlet hole (52*a*) in the first plate (50*a*). Strictly speaking, a distance between a lower end of the second outlet hole (54*b*) of the second plate (50*b*) and a lower end of the second plate (50*b*) is the same as the first distance d1. A distance between an upper end of the second inlet hole (52*b*) and an upper end of the second plate (50*b*) is the same as the second distance d2.

In the plate stack (40), each first plate (50*a*) and an adjacent one of the second plates (50*b*) on the back side of the first plate (50*a*) are welded together at their peripheral portions along the entire perimeter. In the plate stack (40), the first inlet hole (52*a*) of each first plate (50*a*) overlaps the second inlet hole (52*b*) of an adjacent one of the second plates (50*b*) on the front side of the first plate (50*a*), and the rims of the overlapping first inlet hole (52*a*) and second inlet hole (52*b*) are welded together along the entire perimeter.

The first inlet hole (52*a*) and the second inlet hole (52*b*) overlapping each other correspond to the first communication hole. The first inlet hole (52*a*) and the second inlet hole (52*b*) communicate with heating medium channels (42) to introduce the heating medium into the heating medium channels (42).

In the plate stack (40), the first outlet hole (54*a*) of each first plate (50*a*) overlaps the second outlet hole (54*b*) of an adjacent one of the second plates (50*b*) on the front side of the first plate (50*a*), and the rims of the overlapping first outlet hole (54*a*) and second outlet hole (54*b*) are welded together along the entire perimeter. The first outlet hole (54*a*) and the second outlet hole (54*b*) overlapping each other correspond to a second communication hole. The first outlet hole (54*a*) and the second outlet hole (54*b*) are formed below the first communication hole (52*a*, 52*b*) and communicate with the heating medium channels (42) to emit the heating medium out of the heating medium channels (42).

In the plate stack (40), the inlet protrusions (51*a*) and first inlet holes (52*a*) of the first plates (50*a*) and the inlet recesses (51*b*) and second inlet holes (52*b*) of the second plates (50*b*) form the heating medium introduction path (43). In the plate stack (40), the outlet protrusions (53*a*) and first outlet holes (54*a*) of the first plates (50*a*) and the outlet recesses (53*b*) and second outlet holes (54*b*) of the second plates (50*b*) form the heating medium emission path (44).

The heating medium introduction path (43) and the heating medium emission path (44) are passages extending in the stacking direction of the heat transfer plates (50*a*, 50*b*) in the plate stack (40). The heating medium introduction path (43) is a passage blocked from the internal space (21) of the shell (20), and allows all the heating medium channels (42) to communicate with the heating medium inlet (23). The heating medium emission path (44) is a passage blocked from the internal space (21) of the shell (20), and allows all the heating medium channels (42) to communicate with the heating medium outlet (24).

Refrigerant Channel and Heating Medium Channel

The plate stack (40) includes the refrigerant channels (41) and the heating medium channels (42), each of the heating medium channels (42) being adjacent to an associated one of the refrigerant channels (41) with the heat transfer plate (50*a*, 50*b*) interposed therebetween. The heat transfer plate (50*a*, 50*b*) separates the refrigerant channel (41) from the corresponding heating medium channel (42). The first plate (50*a*) has a first corrugated pattern (62*a*), and the second plate (50*b*) has a second corrugated pattern (62*b*). Each of the first and second corrugated patterns includes repetition of long and narrow ridges and grooves.

As illustrated in FIGS. 3A and 3B, the ridges and grooves of the first corrugated pattern (62*a*) extend at a first angle $\alpha 1$ to a horizontal direction X, and the ridges and grooves of the second corrugated pattern (62*b*) extend at a second angle $\alpha 2$ to the horizontal direction X. The first angle $\alpha 1$ and the second angle $\alpha 2$ are supplementary angles. For example, when the first angle $\alpha 1$ is 45 degrees, the second angle $\alpha 2$ is 135 degrees. The first angle $\alpha 1$ ranges from 15 degrees to 75 degrees. The second angle $\alpha 2$ ranges from 165 degrees to 105 degrees.

The first corrugated pattern (62*a*) includes first front-side protrusions (55*a*) protruding toward the front side of the first plate (50*a*) and first back-side protrusions (57*a*) protruding toward the back side of the first plate (50*a*). The first front-side protrusions and the first back-side protrusions are alternately arranged.

The second corrugated pattern (62*b*) includes second front-side protrusions (57*b*) protruding toward the front side of the second plate (50*b*) and second back-side protrusions (55*b*) protruding toward the back side of the second plate (50*b*). The second front-side protrusions and the second back-side protrusions are alternately arranged.

Each of the refrigerant channels (41) is a channel sandwiched between the front surface of the first plate (50*a*) and the back surface of the second plate (50*b*). The refrigerant channel (41) is a channel that communicates with the internal space (21) of the shell (20) and allows the refrigerant to flow through. Strictly speaking, the refrigerant channel (41) includes first channels (45) and first spaces (M). Each of the first channels (45) is formed between a front surface of the first back-side protrusion (57*a*) and a back surface of the second front-side protrusion (57*b*). Each of the first spaces (M) is formed between the first front-side protrusion (55*a*) and the second back-side protrusion (55*b*). The first channels (45) and the first spaces (M) are alternately arranged from the upper end to lower end of the plate stack (40). Upper and lower ends of each first channel (45) communicate with the first spaces (M). The first channels (45) adjacent to each other in the vertical direction communicate with each other through the first space (M). The first channels (45) and the first spaces (M) are open to the internal space (21).

Each of the heating medium channels (42) is a channel sandwiched between the back surface of the first plate (50*a*) and the front surface of the second plate (50*b*). The heating medium channel (42) is a channel blocked from the internal space (21) of the shell (20) and allows the heating medium to flow through. Strictly speaking, the heating medium channel (42) includes second channels (46) and second spaces (N). Each of the second channels (46) is formed between a back surface of the first front-side protrusion (55*a*) and a front surface of the second back-side protrusion (55*b*). Each of the second spaces (N) is formed between the first back-side protrusion (57*a*) and the second front-side protrusion (57*b*). The second channels (46) and the second spaces (N) are alternately arranged from the upper end to lower end of the plate stack (40). Upper and lower ends of each second channel (46) communicate with the second spaces (N). The second channels (46) adjacent to each other in the vertical direction communicate with each other through the second space (N). The second channels (46) and the second spaces (N) are blocked from the internal space of the shell (20).

Guide

As illustrated in FIGS. 2, 3A, and 3B, a guide (70) is provided for the heating medium channel (42). The guide (70) is provided to cross between the first communication hole (52*a*, 52*b*) and the second communication hole (54*a*, 54*b*) when the heat transfer plate (50*a*, 50*b*) is viewed from the front. The guide (70) will be described in detail below.

The guide (70) includes a first linear flat portion (65*a*) and a second linear flat portion (65*b*). Strictly speaking, the first linear flat portion is linearly formed on the back surface of the first plate (50*a*). The first linear flat portion (65*a*) bulges toward the back side of the first plate (50*a*), and has a flat bulging top. The second linear flat portion (65*b*) is linearly formed on the front surface of the second plate (50*b*). The second linear flat portion (65*b*) bulges toward the front side of the second plate (50*b*), and has a flat bulging top.

The second linear flat portion (65*b*) is formed at a position corresponding to the first linear flat portion (65*a*) when the first plate (50*a*) and the second plate (50*b*) are stacked.

In the plate stack (40), the first linear flat portion (65*a*) of the first plate (50*a*) and the second linear flat portion (65*b*) of the second plate (50*b*) adjacent to the back surface of the first plate (50*a*) overlap each other, and the overlapping first linear flat portion (65*a*) and second linear flat portion (65*b*) are joined together over the entire length by, for example, brazing. The guide (70) is formed of the first linear flat portion (65*a*) and the second linear flat portion (65*b*) joined together.

The guide (70) has a first guide portion (70*a*) and a second guide portion (70*b*). The first guide portion (70*a*) is in the middle of the lower end of the first communication hole (52*a*, 52*b*) and the upper end of the second communication hole (54*a*, 54*b*), and linearly extends in the width direction of the heat transfer plate (50*a*, 50*b*). The second guide portion (70*b*) linearly extends downward from each end of the first guide portion (70*a*). The guide (70) is arranged symmetrically with respect to a center line Y of the heat transfer plate (50*a*, 50*b*).

The first linear flat portion (65*a*) of the first guide portion (70*a*) is in the middle of the first inlet hole (52*a*) and the first outlet hole (54*a*) of the first plate (50*a*), and extends in the width direction of the first plate (50*a*). The first linear flat portion (65*a*) of the first guide portion (70*a*) is located between two first front-side protrusions (55*a*) adjacent to each other in the vertical direction.

The second linear flat portion (65*b*) of the first guide portion (70*a*) is in the middle of the second inlet hole (52*b*) and the second outlet hole (54*b*) of the second plate (50*b*), and extends in the width direction of the second plate (50*b*). The second linear flat portion (65*b*) of the first guide portion (70*a*) is located between two second back-side protrusions (55*b*) adjacent to each other in the vertical direction. The first guide portion (70*a*) has a length L1 which is approximately half the length from one end to the other end of the heat transfer plate (50*a*, 50*b*).

The first linear flat portion (65*a*) of the second guide portion (70*b*) is formed to extend downward from each end of the first linear flat portion (65*a*) on the back surface of the first plate (50*a*). The second linear flat portion (65*b*) of the second guide portion (70*b*) is formed to extend downward from each end of the first linear flat portion (65*a*) on the front surface of the second plate (50*b*). The second guide portion (70*b*) has a length L2 which is approximately one third of the length L1 of the first guide portion (70*a*). A lower end of the second guide portion (70*b*) is located below the upper end of the second communication hole (54*a*, 54*b*). Strictly speaking, the lower end of the second guide portion (70*b*) is located at a position lower than the position of the center (O) of the second communication hole (54*a*, 54*b*).

More strictly, the lower end of the second guide portion (70*b*) is located at a height substantially in the middle of the center (O) of the second communication hole (54*a*, 54*b*) and the lower end of the second communication hole (54*a*. 54*b*).

Flows of Heating Medium and Refrigerant

How the heating medium and the refrigerant flow in the heat exchanger (10) will be specifically described with reference to FIGS. 4 and 5. Arrows shown in FIG. 4 indicate the flow of the heating medium. FIG. 5 shows that the liquid refrigerant is stored in the shell. Solid arrows indicate the flow of the heating medium, and broken line arrows indicate the flow of the refrigerant.

Figure 4:
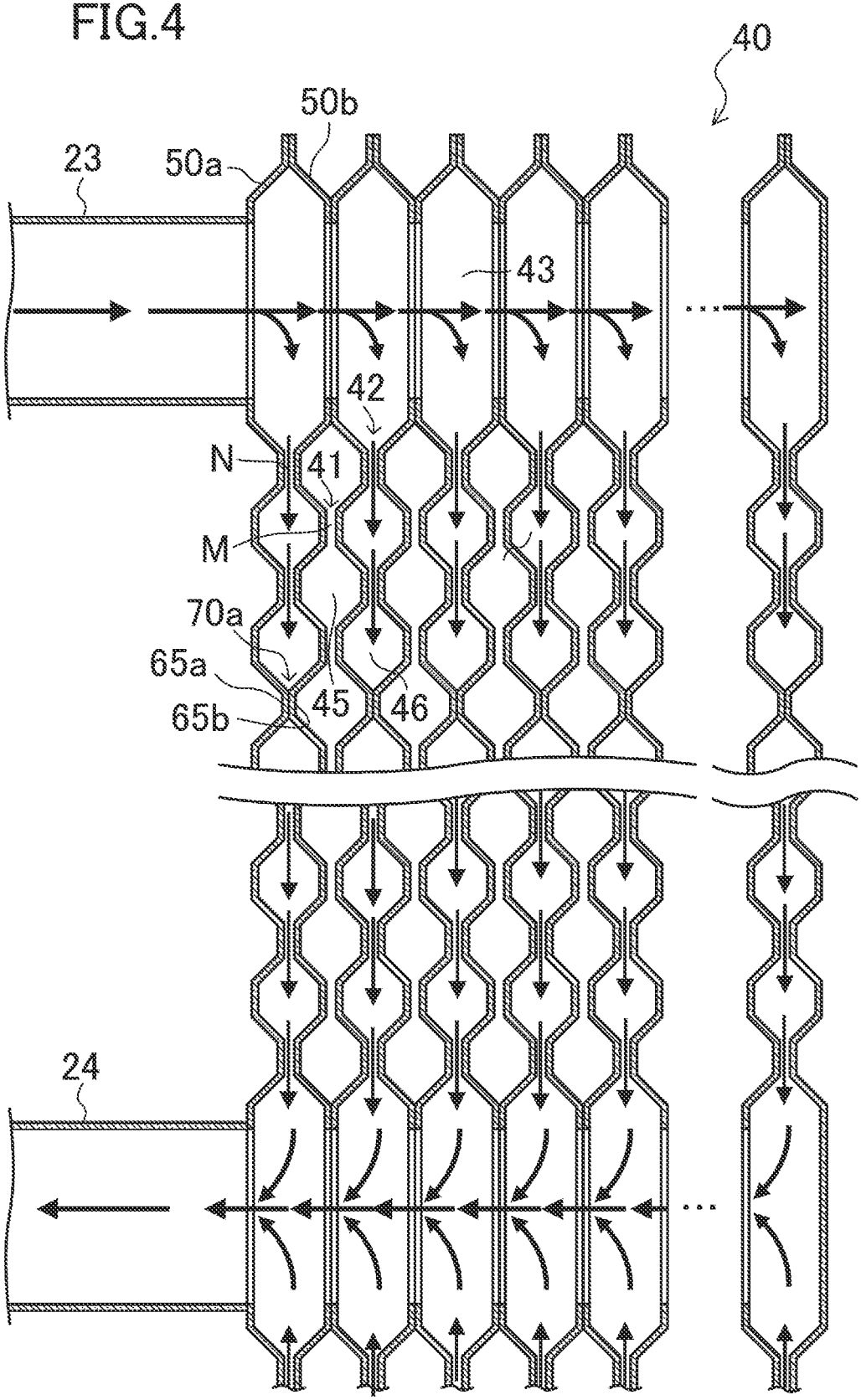
FIG. 4 is a schematic view illustrating the flow of a heating medium in the plate stack.
Figure 5:
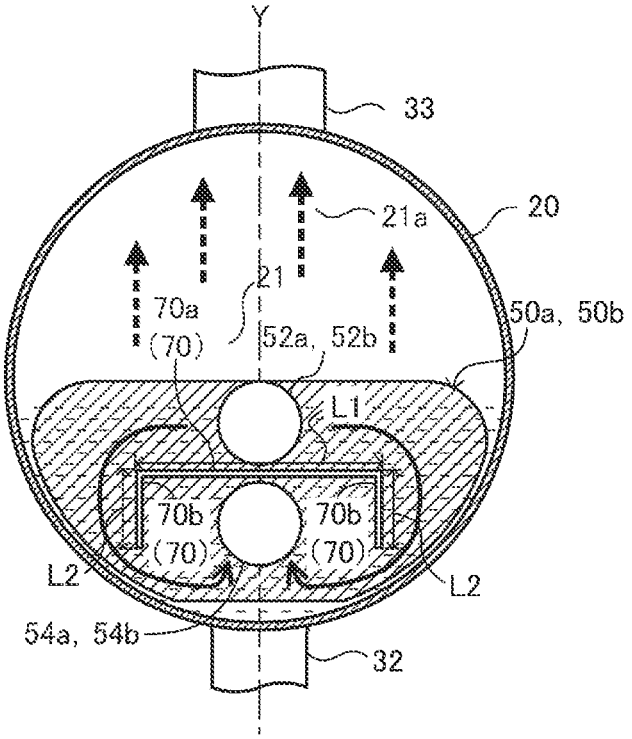
FIG. 5 is a schematic view illustrating the flow of the heating medium on a heat transfer plate.

As illustrated in FIG. 4, the heating medium flows from the heating medium inlet (23) into the heating medium introduction path (43). The heating medium passing through the heating medium introduction path (43) flows from the first communication hole (52*a*, 52*b*) to the second communication hole (54*a*, 54*b*) through the heating medium channels (42). Strictly speaking, the heating medium flowing through the heating medium introduction path (43) enters the second channel (46). The heating medium flows along the second channel (46), and enters another adjacent second channel (46) below the former second channel (46) through the second space (N).

In this manner, the heating medium flows downward while flowing toward both lateral ends of the heat transfer plate (50*a*, 50*b*).

As illustrated in FIG. 5, the heating medium that has flowed into the heating medium channels (42) from the first communication hole (52*a*, 52*b*) is guided toward side portions of the heat transfer plate (50*a*. 50*b*) by the guide (70). Strictly speaking, the first guide portion blocks the heating medium from flowing downward in the heating medium channels (42), and allows the heating medium to flow toward the side portions of the heat transfer plate (50*a*, 50*b*). The heating medium that has moved to the side portions of the heat transfer plate (50*a*, 50*b*) by the first guide portion (70*a*) flows to a lower portion of the heat transfer plate (50*a*, 50*b*) along the second guide portions (70*b*).

The heating medium that has passed the lower end of each second guide portion (70*b*) flows near the lower end of the heat transfer plate (50*a*, 50*b*) toward the widthwise center portion of the heat transfer plate (50*a*, 50*b*). Around the second communication hole (54*a*, 54*b*), flows of the heating medium toward the second communication hole (54*a*, 54*b*) from both sides of the second communication hole (54*a*, 54*b*) and a flow of the heating medium toward the second communication hole (54*a*, 54*b*) from below the second communication hole (54*a*, 54*b*) are generated. The heating medium coming from the lateral sides and lower side of the second communication hole (54*a*, 54*b*) flows into the second communication hole (54*a*, 54*b*).

Next, how the refrigerant flows will be described below. The refrigerant that has passed through an expansion valve in the refrigerant circuit flows toward the heat exchanger (10). This liquid refrigerant flows into the internal space (21) of the shell (20) through the refrigerant inlet (32). The liquid refrigerant stored in the internal space (21) reaches close to the upper end of the plate stack (40). The plate stack (40) is immersed in the liquid refrigerant. The refrigerant stored in the internal space (21) has a relatively low pressure. The low-pressure refrigerant exchanges heat with the heating medium flowing through the heating medium channels (42). Strictly speaking, the refrigerant channel (41) and the heating medium channel (42) are adjacent to each other with the heat transfer plate (50*a*, 50*b*) interposed therebetween. Thus, the liquid refrigerant absorbs heat from the heating medium flowing through the heating medium channel (42) and evaporates. The evaporated refrigerant moves from the refrigerant channel (41) to the upper space (21*a*) which is an upper portion of the internal space (21). The refrigerant in the upper space (21*a*) flows into the refrigerant circuit through the refrigerant outlet (33).

Feature (1) of Embodiment

The guide (70) crossing between the first communication hole (52*a*, 52*b*) and the second communication hole (54*a*, 54*b*) is provided for the heating medium channels (42) to guide the heating medium that has flowed into the heating medium channels (42) from the first communication hole (52*a*, 52*b*) toward the side portions of the heat transfer plate (50*a*. 50*b*).

A known plate stack of a shell-and-plate heat exchanger includes heating medium channels and refrigerant channels, each of the heating medium channels being adjacent to an associated one of the refrigerant channels with a heat transfer plate interposed therebetween. Each heat transfer plate is provided with two holes communicating with the heating medium channels, and the heating medium flows through the heating medium channels from one hole to the other hole. When the heating medium flows from one hole to the other hole in the shortest distance, the heating medium does not easily spread over the entire heat transfer plate. For example, in a portion of the heat transfer plate away from the holes, such as an end portion in the width direction of the heat transfer plate, the heating medium stays still and does not exchange heat with the refrigerant. Thus, the whole heat transfer plate cannot be effectively used for the heat exchange, resulting in only a small amount of heat exchange.

In contrast, according to the feature (1) of this embodiment, the first guide portion (70*a*) allows the heating medium flowing through the heating medium channels (42) to go toward the side portions of the heat transfer plate (50*a*, 50*b*).

Thereafter, the heating medium flows from the ends of the first guide portion (70*a*) along the second guide portions (70*b*). The heating medium flowing along the second guide portions (70*b*) makes contact only with a region of the heat transfer plate (50*a*, 50*b*) outside the second guide portions (70*b*). Thus, the heating medium coming near the lower end of the heat transfer plate (50*a*. 50*b*) has a higher temperature than the heating medium flowing in contact with the entire heat transfer plate (50*a*, 50*b*) in the width direction. This can keep a temperature difference between the refrigerant and the heating medium in a lower portion of the heat transfer plate (50*a*, 50*b*), improving the performance of the heat exchanger (10). The first communication hole (52*a*, 52*b*) is formed in the upper portion of the heat transfer plate (50*a*, 50*b*). The heating medium that has flowed from the first communication hole (52*a*, 52*b*) spreads to the side portions of the heat transfer plate (50*a*, 50*b*) along the first guide portion (70*a*). This accelerates evaporation of the refrigerant in the upper portion of the plate stack (40), and can reduce the amount of liquid refrigerant droplets coming out of the heat exchanger together with the gas refrigerant.

Feature (2) of Embodiment

The lower end of the guide (70) is located below the upper end of the second communication hole (54*a*, 54*b*).

According to the feature (2), the heating medium flows around the lower ends of the guide (70) and enters the second communication hole (54*a*. 54*b*). The heating medium reaches the lower portion of the heat transfer plate (50*a*, 50*b*) without decreasing its temperature so much, as compared with the case where no guide (70) is provided. This can maintain the temperature difference between the refrigerant and the heating medium in the lower portion of the heat transfer plate (50*a*, 50*b*). As a result, heat exchange efficiency can be kept from decreasing, and the performance of the heat exchanger (10) can be improved.

Feature (3) of Embodiment

In the heat exchanger of this embodiment, the distance between the lower end of the second communication hole (54*a*, 54*b*) and the lower end of the heat transfer plate (50*a*, 50*b*) is greater than the distance between the upper end of the first communication hole (52*a*, 52*b*) and the upper end of the heat transfer plate (50*a*, 50*b*).

According to the feature (3), the second communication hole (54*a*, 54*b*) is at some distance from the lower end of the heat transfer plate (50*a*, 50*b*). The heating medium passing through the heating medium channels (42) flows around the lower ends of the second guide portions (70*b*), and then goes upward to the second communication hole (54*a*, 54*b*). Thus, the heating medium flowing near the lower end of the heat transfer plate (50*a*, 50*b*) has a higher temperature than the heating medium flowing into the second communication hole (54*a*, 54*b*).

This can keep the temperature of the heating medium from decreasing at the lower end of the heat transfer plate (50*a*, 50*b*), and can keep the heat exchange efficiency of the heat exchanger (10) from decreasing.

Feature (4) of Embodiment

In the heat exchanger of this embodiment, the center of the second communication hole (54*a*, 54*b*) is located at a position higher than the position of the lower end of the guide (70).

According to the feature (4), the heating medium flows into the second communication hole (54*a*, 54*b*) from below the second communication hole (54*a*, 54*b*). Thus, the ratio of the heating medium flowing into the second communication hole (50*a*, 50*b*) without passing near the lower end of the heat transfer plate (54*a*, 54*b*) decreases. i.e., the ratio of the heating medium flowing near the lower end of the heat transfer plate (50*a*. 50*b*) increases. The heating medium passing near the lower end of the heat transfer plate has a relatively high temperature. This can improve the heat exchange efficiency between the refrigerant and the heating medium at the lower end of the heat transfer plate (50*a*, 50*b*).

Feature (5) of Embodiment

The guide (70) is formed of the protrusion (57*a*, 57*b*) or the recess (56*a*. 56*b*) formed in the heat transfer plate (50*a*, 50*b*).

According to this feature (5), the guide (70) can be formed integrally with the heat transfer plate by pressing, for example. This allows easy manufacture of the heat transfer plate (50*a*, 50*b*), and makes the manufacturing process of the plate stack (40) less complicated.

Other Embodiments

The heat exchanger (10) of the embodiment may be modified into the following variations. The following variations may be combined or replaced without deteriorating the functions of the heat exchanger (10).

First Variation

Figure 6:
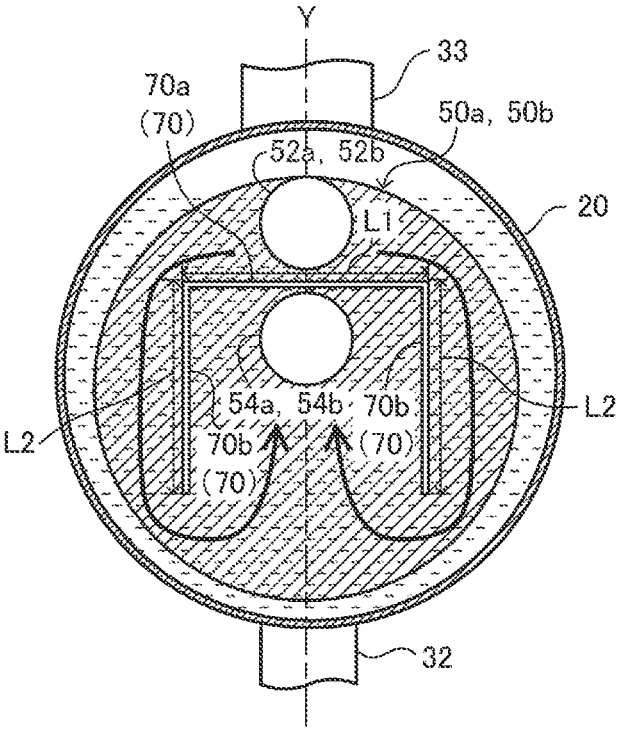
FIG. 6 is a view corresponding to FIG. 5, illustrating a heat exchanger of a first variation.

As illustrated in FIG. 6, the heat transfer plates (50*a*, 50*b*) of a first variation are formed in a substantially circular shape. The first communication hole (52*a*, 52*b*) is formed near the upper end of the heat transfer plate (50*a*, 50*b*). The second communication hole (54*a*, 54*b*) is provided between the lower end of the first communication hole (52*a*, 52*b*) and the center of the heat transfer plate (50*a*, 50*b*). Arrows in the drawing indicate the flow of the heating medium.

The first guide portion (70*a*) of the guide (70) of the first variation is located at a position in the middle of the lower end of the first communication hole (52*a*, 52*b*) and the upper end of the second communication hole (54*a*, 54*b*). The length L1 of the first guide portion (70*a*) is approximately equal to the radius of the heat transfer plate (50*a*, 50*b*). The second guide portion (70*b*) is formed to extend from each of the ends of the first guide portion (70*a*) to the lower portion of the heat transfer plate (50*a*, 50*b*). Strictly speaking, a distance between the position of the lower end of the second guide portion (70*b*) and the position of the lower end of the second communication hole (54*a*. 54*b*) is greater than a distance between the position of the lower end of the second guide portion (70*b*) and the position of the lower end of the heat transfer plate (50*a*, 50*b*). The length L2 of the second guide portion (70*b*) is greater than the length L1 of the first guide portion (70*a*).

According to the first variation, the heating medium flows laterally along the first guide portion (70*a*) from the first communication hole (52*a*, 52*b*), and then flows along the second guide portions to the lower portion of the heat transfer plate (50*a*, 50*b*). The heating medium flows upward from the lower ends of the second guide portions (70*b*) to the second communication hole (54*a*, 54*b*). This can maintain a sufficient distance from the first communication hole (52*a*, 52*b*) to the second communication hole (54*a*, 54*b*), keeping the heat exchange efficiency between the heating medium and the refrigerant from decreasing. The distance that the heating medium flows upward from the lower ends of the second guide portions (70*b*) to the second communication hole (54*a*, 54*b*) is relatively long. This can keep a sufficient temperature difference between the heating medium at the lower end of the heat transfer plate (50*a*, 50*b*) and the heating medium in the second communication hole (54*a*. 54*b*). Thus, the temperature of the heating medium at the lower end of the heat transfer plate (50*a*, 50*b*) is relatively high, accelerating the heat exchange between the refrigerant and the heating medium in the lower portion of the heat transfer plate (50*a*. 50*b*). Moreover, the second communication hole (54*a*, 54*b*) located at a relatively high position allows storage of a relatively large amount of liquid refrigerant.

Second Variation

Figure 7:
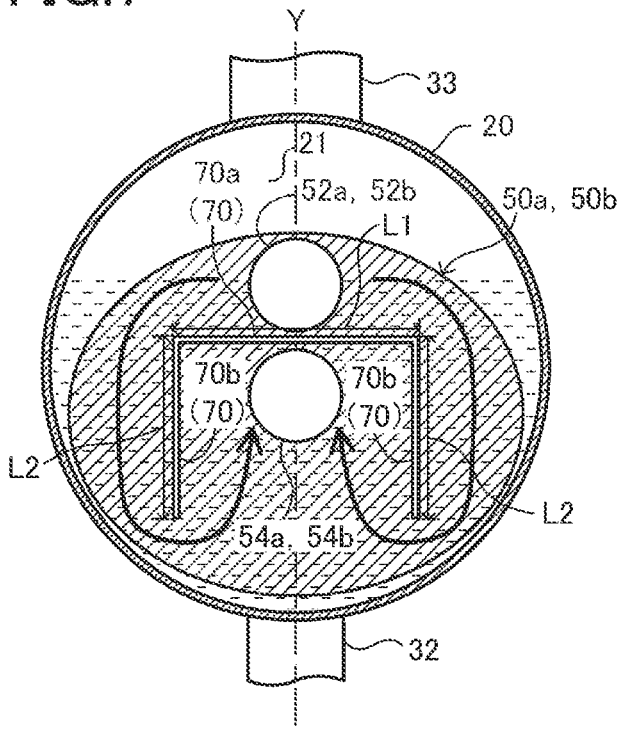
FIG. 7 is a view corresponding to FIG. 5, illustrating a heat exchanger of a second variation.

As illustrated in FIG. 7, the heat transfer plates (50*a*, 50*b*) of a second variation are formed in a substantially elliptical shape. The first communication hole (52*a*, 52*b*) is formed near the upper end of the heat transfer plate (50*a*, 50*b*). Arrows in the drawing indicate the flow of the heating medium.

The second communication hole (54*a*, 54*b*) is formed immediately below the first communication hole (52*a*, 52*b*) and near the center of the heat transfer plate (50*a*, 50*b*). The length L1 of the first guide portion (70*a*) is substantially equal to half of the major axis of the heat transfer plate (50*a*, 50*b*). The second guide portion (70*b*) is formed to extend from each of the ends of the first guide portion (70*a*) to a lower portion of the heat transfer plate (50*a*, 50*b*).

Strictly speaking, the lower end of the second guide portion (70*b*) is located at a relatively great distance from the lower end of the second communication hole (54*a*, 54*b*).

The length L2 of the second guide portion (70*b*) is equal to or greater than the length L1 of the first guide portion (70*a*).

According to the second variation, the heating medium flows laterally along the first guide portion (70*a*) from the first communication hole (52*a*, 52*b*), and then flows along the second guide portions to the lower portion of the heat transfer plate (50*a*, 50*b*). The heating medium flows upward from the lower ends of the second guide portions (70*b*) to the second communication hole (54*a*, 54*b*). This can maintain a sufficient distance from the first communication hole (52*a*, 52*b*) to the second communication hole (54*a*, 54*b*), keeping the heat exchange efficiency between the heating medium and the refrigerant from decreasing. The distance that the heating medium flows upward from the lower ends of the second guide portions (70*b*) to the second communication hole (54*a*, 54*b*) is relatively long. This can keep a sufficient temperature difference between the heating medium at the lower end of the heat transfer plate (50*a*, 50*b*) and the heating medium in the second communication hole (54*a*, 54*b*). Thus, the temperature of the heating medium at the lower end of the heat transfer plate (50*a*, 50*b*) is relatively high, accelerating the heat exchange between the refrigerant and the heating medium in the lower portion of the heat transfer plate (50*a*. 50*b*). A space is formed above the plate stack in the internal space (21) of the shell (20). The liquid refrigerant that failed to evaporate in this space falls onto the plate stack (40). This can keep the liquid refrigerant from flowing out of the refrigerant outlet, which can avoid the carry-over.

Third Variation

Figure 8:
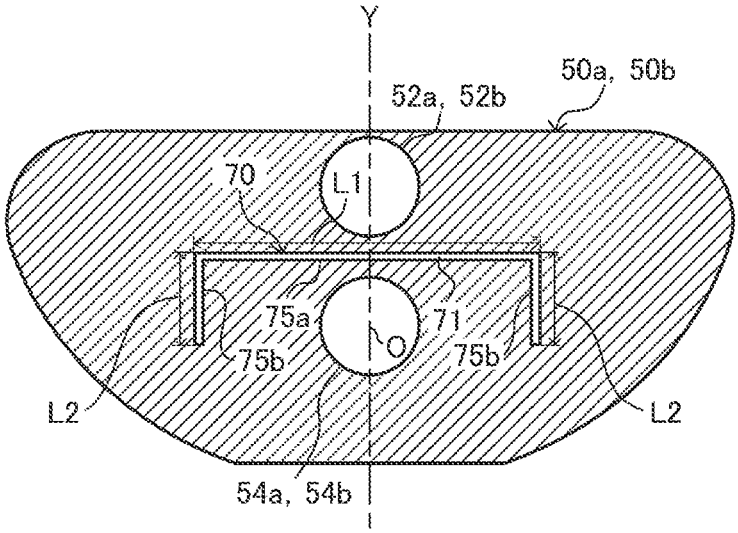
FIG. 8 is a schematic front view illustrating a heat transfer plate of a third variation.

As illustrated in FIG. 8, the guide (70) of a third variation is formed of an elongated plate member (75). The plate member (75) includes a first plate portion (75*a*) and a second plate portion (75*b*). The first plate portion (75*a*) is provided between the first communication hole (52*a*, 52*b*) and the second communication hole (54*a*, 54*b*). The second plate portion (75*b*) extends downward from each end of the first plate portion (75*a*). The first plate portion (75*a*) has a length L1 which is approximately half the length from one end to the other end of the heat transfer plate (50*a*, 50*b*). The second plate portion (75*b*) has a length L2 which is approximately one third of the length L1 of the first plate portion (75*a*). A lower end of the second plate portion (75*b*) is located at a height in the middle of the center O of the second communication hole (54*a*, 54*b*) and the lower end of the second communication hole (54*a*, 54*b*).

Fourth Variation

Figure 9:
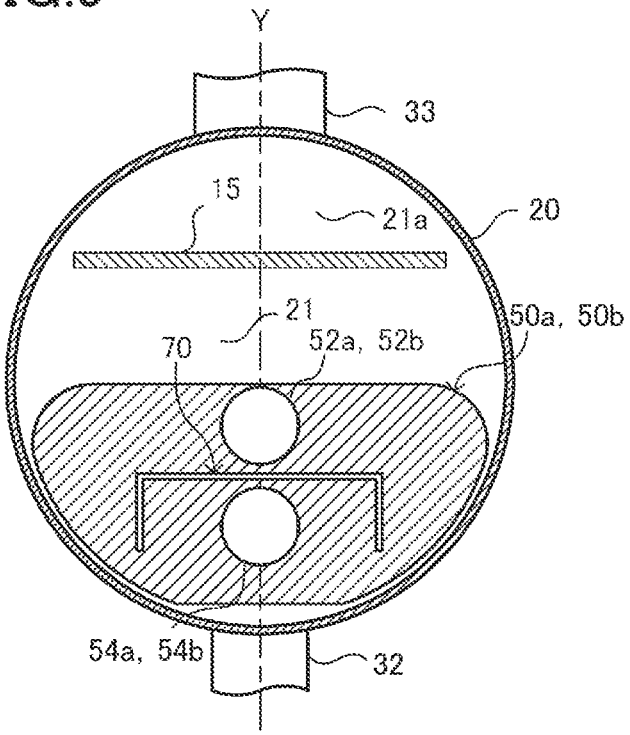
FIG. 9 is a view corresponding to FIGS. 3A and 3B, illustrating a heat exchanger of a fourth variation.

As illustrated in FIG. 9, the heat exchanger (10) of the embodiment may include an eliminator (15). The eliminator (15) is a member for capturing droplets of the liquid refrigerant flowing together with the gas refrigerant. The eliminator (15) is in a thick plate shape made of a stack of metal meshes, for example, and allows the refrigerant to pass through in the thickness direction.

The eliminator (15) is housed in the internal space (21) of the shell (20). The eliminator (15) is placed to traverse the internal space (21) of the shell (20) above the plate stack (40). The gas refrigerant passed through the eliminator (15) flows out of the shell (20) through the refrigerant outlet (33). The liquid refrigerant captured by the eliminator (15) falls down in the form of relatively large droplets.

Fifth Variation

Figure 10:
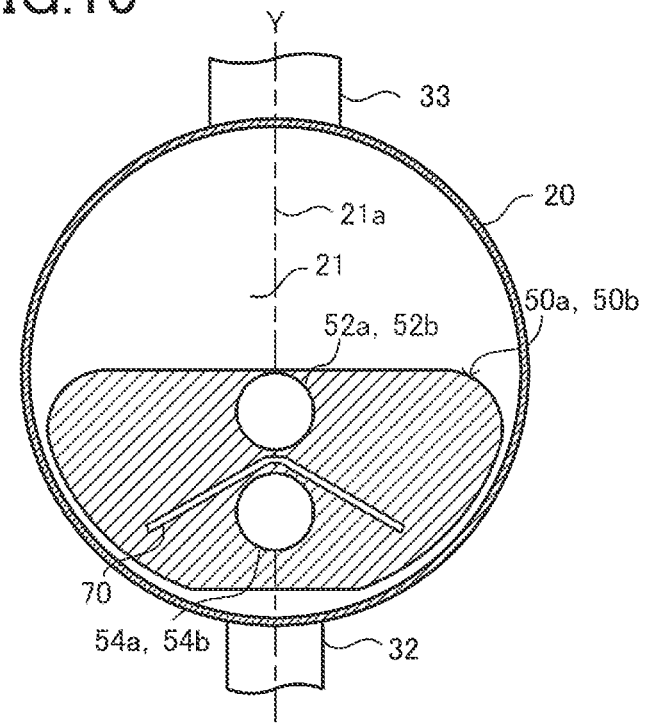
FIG. 10 is a view corresponding to FIGS. 3A and 3B, illustrating a heat exchanger of a fifth variation.

As illustrated in FIG. 10, the guide (70) may be formed in an inverted V shape when the heat transfer plate (50*a*, 50*b*) is viewed from the front. The guide (70) has an apex formed between the lower end of the first communication hole (52*a*, 52*b*) and the upper end of the second communication hole (54*a*, 54*b*). Although not shown, the guide (70) may be formed in an inverted U shape.

Sixth Variation

The first angle $\alpha$1 of the first corrugated pattern (62*a*) may be the same as the second angle $\alpha$2 of the second corrugated pattern (62*b*). For example, both the first angle $\alpha$1 of the first corrugated pattern (62*a*) and the second angle $\alpha$2 of the second corrugated pattern (62*b*) may be zero degrees, i.e., the first corrugated pattern (62*a*) and the second corrugated pattern (62*b*) may extend in the horizontal direction.

Seventh Variation

The heat exchanger (10) of the embodiment may be a falling film type shell-and-plate heat exchanger. Strictly speaking, the heat exchanger (10) may include a sprayer arranged above the plate stack (40) in the shell (20) to spray the liquid refrigerant onto the plate stack (40). Alternatively, the heat exchanger (10) may include a plate stack having a structure that sprays the liquid refrigerant.

While the embodiments and variations thereof have been described above, it will be understood that various changes in form and details may be made without departing from the spirit and scope of the claims. The embodiments and the variations thereof may be combined and replaced with each other without deteriorating intended functions of the present disclosure. The ordinal numbers such as "first," "second," "third," . . . , described above are used to distinguish the terms to which these expressions are given, and do not limit the number and order of the terms.

As can be seen from the foregoing description, the present disclosure is useful for a shell-and-plate heat exchanger.

The invention claimed is:

1. A shell and plate heat exchanger, comprising:

a shell forming an internal space; and a plate stack housed in the internal space of the shell, the plate stack including a plurality of heat transfer plates stacked in a lateral direction and joined together, the shell and plate heat exchanger being configured to allow a refrigerant that has flowed into the internal space of the shell to evaporate, the plate stack forming a plurality of refrigerant channels that communicate with the internal space of the shell and allow a refrigerant to flow through and a plurality of heating medium channels that are blocked from the internal space of the shell and allow a heating medium to flow through, each of the refrigerant channels being adjacent to an associated one of the heating medium channels with heat transfer plate interposed therebetween, each of the heat transfer plates including a first communication hole that communicates with the heating medium channels to introduce the heating medium into the heating medium channels, and a second communication hole formed below the first communication hole that communicates with the heating medium channels to emit the heating medium out of the heating medium channels, and a guide crossing between the first communication hole and the second communication hole to guide the heating medium that has flowed into the heating medium channels from the first communication hole toward side portions of the heat transfer plate, a right end or a left end of the guide being located lateral to the second communication hole and being located below an upper end of the second communication hole, the guide intersecting a line segment extending between a lower end of the first communication hole and the upper end of the second communication hole, the guide being formed by adjacent ones of the plurality of heat transfer plates being joined together, a distance between a lower end of the second communication hole and a lower end of the heat transfer plate being greater than a distance between an upper end of the first communication hole and an upper end of the heat transfer plate, the guide being formed such that the heating medium does not pass therethrough over an entire length thereof.

2. The shell and plate heat exchanger of claim 1, wherein a center of the second communication hole is located at a position higher than a position of a lower end of the guide.

3. The shell and plate heat exchanger of claim 2, wherein the guide is a plate member disposed to penetrate the plurality of heat transfer plates stacked and joined together.

4. The shell and plate heat exchanger of claim 2, wherein the guide is formed of a heat transfer plate protrusion or a heat transfer plate recess.

5. The shell and plate heat exchanger of claim 1, wherein the guide is formed of a heat transfer plate protrusion or a heat transfer plate recess.

6. A shell and plate heat exchanger comprising:

a shell forming an internal space; and a plate stack housed in the internal space of the shell, the plate stack including a plurality of heat transfer plates stacked in a lateral direction and joined together, the shell and plate heat exchanger being configured to allow a refrigerant that has flowed into the internal space of the shell to evaporate, the plate stack forming a plurality of refrigerant channels that communicate with the internal space of the shell and allow a refrigerant to flow through and a plurality of heating medium channels that are blocked from the internal space of the shell and allow a heating medium to flow through, each of the refrigerant channels being adjacent to an associated one of the heating medium channels with heat transfer plate interposed therebetween, each of the heat transfer plates including a first communication hole that communicates with the heating medium channels to introduce the heating medium into the heating medium channels, and a second communication hole formed below the first communication hole that communicates with the heating medium channels to emit the heating medium out of the heating medium channels, and a guide crossing between the first communication hole and the second communication hole to guide the heating medium that has flowed into the heating medium channels from the first communication hole toward side portions of the heat transfer plate, a right end or a left end of the guide being located lateral to the second communication hole and being located below an upper end of the second communication hole, the guide intersecting a line segment extending between a lower end of the first communication hole and the upper end of the second communication hole, the guide being formed by adjacent ones of the plurality of heat transfer plates being joined together, a distance between a lower end of the second communication hole and a lower end of the heat transfer plate being greater than a distance between an upper end of the first communication hole and an upper end of the heat transfer plate, the guide being a plate member disposed to penetrate the plurality of heat transfer plates stacked and joined together.

7. The shell and plate heat exchanger of claim 6, wherein a center of the second communication hole is located at a position higher than a position of a lower end of the guide.

8. The shell and plate heat exchanger of claim 6, wherein the guide is formed of a heat transfer plate protrusion or a heat transfer plate recess.

9. A shell and plate heat exchanger, comprising:

a shell forming an internal space; and a plate stack housed in the internal space of the shell, the plate stack including a plurality of heat transfer plates stacked in a lateral direction and joined together, the shell and plate heat exchanger being configured to allow a refrigerant that has flowed into the internal space of the shell to evaporate, the plate stack forming a plurality of refrigerant channels that communicate with the internal space of the shell and allow a refrigerant to flow through and a plurality of heating medium channels that are blocked from the internal space of the shell and allow a heating medium to flow through, each of the refrigerant channels being adjacent to an associated one of the heating medium channels with heat transfer plate interposed therebetween, each of the heat transfer plates including a first communication hole that communicates with the heating medium channels to introduce the heating medium into the heating medium channels, and a second communication hole formed below the first communication hole that communicates with the heating medium channels to emit the beating medium out of the heating medium channels, and a guide crossing between the first communication hole and the second communication hole to guide the heating medium that has flowed into the heating medium channels from the first communication hole toward side portions of the heat transfer plate, a right end or a left end of the guide being located lateral to the second communication hole and being located below an upper end of the second communication hole, the guide intersecting a line segment extending between a lower end of the first communication hole and the upper end of the second communication hole, the guide being formed by adjacent ones of the plurality of heat transfer plates being joined together, a distance between a lower end of the second communication hole and a lower end of the heat transfer plate being greater than a distance between an upper end of the first communication hole and an upper end of the heat transfer plate, the guide being formed by the adjacent ones of the heat transfer plates joined together along an entire length of the guide.

10. The shell and plate heat exchanger of claim 9, wherein the guide is formed by a first linear flat portion and a second linear flat portion formed respectively on the adjacent ones of the heat transfer plates joined together along an entire length thereof.

11. The shell and plate heat exchanger of claim 9, wherein a center of the second communication hole is located at a position higher than a position of a lower end of the guide.

12. The shell and plate heat exchanger of claim 9, wherein the guide is formed of a heat transfer plate protrusion or a heat transfer plate recess.

* * * * *